United States Patent [19]

Häfner et al.

[11] Patent Number: 4,763,841

[45] Date of Patent: Aug. 16, 1988

[54] INJECTION NOZZLE FOR INJECTING FUEL INTO THE COMBUSTION CHAMBER OF AN AIR-COMPRESSING FUEL-INJECTION ENGINE

[75] Inventors: Günther Häfner, Berglen; Ulrich Letsche, Stuttgart, both of Fed. Rep. of Germany

[73] Assignee: Daimler-Benz Aktiengesellschaft, Stuttgart, Fed. Rep. of Germany

[21] Appl. No.: 35,856

[22] Filed: Apr. 8, 1987

[30] Foreign Application Priority Data

Apr. 29, 1986 [DE] Fed. Rep. of Germany ..... 3614564

[51] Int. Cl.[4] ..... B05B 1/34; F02M 61/20

[52] U.S. Cl. ..... 239/464; 239/468; 239/533.9; 137/510; 137/906

[58] Field of Search ..... 239/464, 468, 486, 87, 239/533.3–533.14; 137/859, 906, 510; 251/61.1

[56] References Cited

U.S. PATENT DOCUMENTS

| | | | |
|---|---|---|---|
| 2,084,057 | 6/1937 | French . | |
| 2,638,127 | 5/1953 | Griswold | 137/859 X |
| 3,079,946 | 3/1963 | Rosler | 137/859 X |
| 3,175,771 | 3/1965 | Breting | 239/468 X |
| 4,192,466 | 3/1980 | Tarasawa et al. | 239/464 |
| 4,241,756 | 12/1980 | Bennett et al. | 137/859 X |

FOREIGN PATENT DOCUMENTS

| | | |
|---|---|---|
| 304032 | 2/1918 | Fed. Rep. of Germany . |
| 360136 | 9/1922 | Fed. Rep. of Germany . |
| 489508 | 1/1930 | Fed. Rep. of Germany . |
| 840481 | 6/1952 | Fed. Rep. of Germany . |

*Primary Examiner*—Andres Kashnikow
*Assistant Examiner*—Mary Beth O. Jones
*Attorney, Agent, or Firm*—Barnes & Thornburg

[57] ABSTRACT

An injection nozzle for injecting fuel into the combustion chamber of an air-compressing internal combustion engine is provided, having a valve closing member which lifts inwards from its valve seat as a function of the fuel pressure. The valve closing member is formed by a diaphragm which is firmly clamped in the nozzle body and lifts to a greater extent during the opening pressure of the injected fuel in the direction of the spray openings. A dilatant liquid or a non-dilatant liquid with a certain portion of gas is used as a closing spring for the diaphragm.

14 Claims, 3 Drawing Sheets

INJECTION NOZZLE FOR INJECTING FUEL INTO THE COMBUSTION CHAMBER OF AN AIR-COMPRESSING FUEL-INJECTION ENGINE

BACKGROUND AND SUMMARY OF THE INVENTION

The present invention relates to an injection nozzle for injecting fuel into a combustion chamber of an air-compressing fuel-injection internal combustion engine. The nozzle has a diaphragm acting as a valve closer in the nozzle body. The diaphragm is liftable from its valve seat against a spring closing force as a function of injected-fuel pressure prevailing in a pressure chamber in the nozzle body to clear a spray hole leading toward the combustion chamber.

Injection nozzles of this general type are known. Nozzle needles are provided as valve closing members which open against the flow direction of the fuel. The opening lifting movements of these nozzle needles are limited by stops. This results in a constant spraying cross-section at least in the upper load range at varying speeds of the internal combustion engine. Since leakage cannot be avoided in injection nozzles of this type, complicated fuel-return systems are necessary.

An object of the present invention is to avoid the above-mentioned disadvantages and to provide an injection nozzle as a single-jet nozzle which is technically uncomplicated and has a small overall height. Another object is to provide an injection nozzle making possible a variable spraying cross-section adapted to the speed of the internal combustion engine, which also provides an approximately uniform spraying quality.

This and other objects are achieved in the present invention by providing in an injection nozzle a diaphragm that is a conical spray plug that is reoeived in a spray hole when the diaphragm is in the closed position. The nozzle includes an enclosed fluid which is under pressure when the diaphragm is in the closed position for applying the closing spring force.

An injection nozzle which can be produced inexpensively, works free of leaks, is of low construction and has a self-adjusting spraying cross-section results from constructions according to preferred embodiments of the present invention. A conventional steel spring or a fluid, namely a dilatant liquid or a non-dilatant liquid with a certain portion of gas, is used as a closing spring for this injection nozzle in preferred embodiments. In a further preferred embodiment, the diaphragm of the injection nozzle is designed as a closing spring.

Other objects, advantages and novel features of the present invention will become apparent from the following detailed description of the invention when considered in conjunction with the accompanying drawings.

DETAILED DESCRIPTION OF THE DRAWINGS

Figure 1:
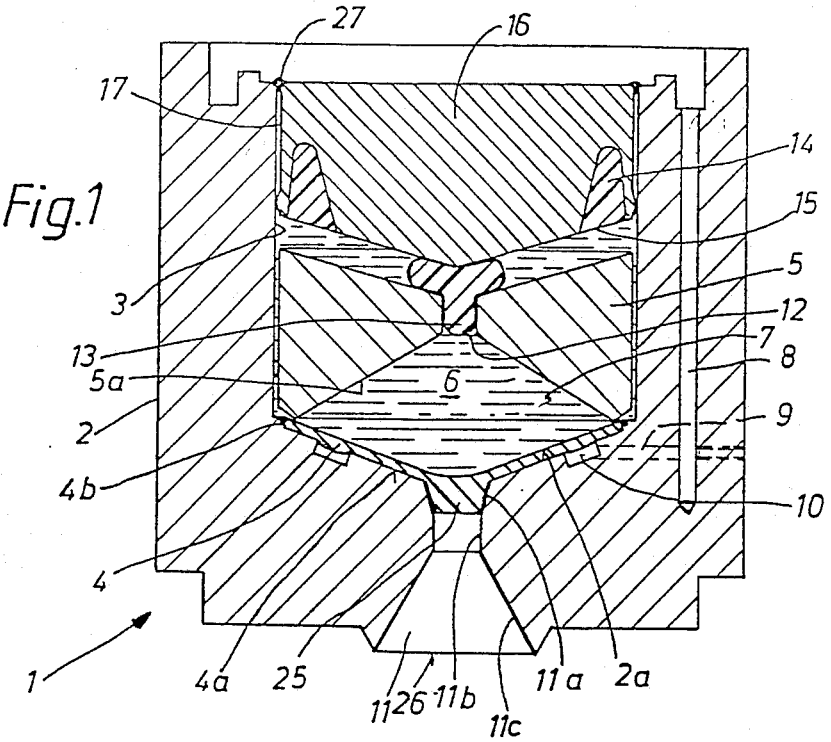
FIG. 1 shows an injection nozzle constructed in accordance with a preferred embodiment of the present invention.

An injection nozzle 1 provided for air-compressing fuel-injection internal combustion engines is shown in the preferred embodiment of FIG. 1 as a single-jet nozzle, and mainly comprises a nozzle body 2 with a cylindrical recess 3 and a valve closing member 4. The closing member 4 is in the recess 3 as a diaphragm shaped like a disc.

The diaphragm sits on its conical seat 4*a* in the nozzle body 2 on a correspondingly shaped conical valve seat surface 2*a*. The diaphragm 4 is connected in a sealing manner at the diaphragm edge 4*b* to the nozzle body 2 by electron-beam or laser welding, for example. A spring backing member 5 fitted and fixed in the cylindrical recess 3 of the nozzle body rests on the diaphragm edge 4*b*. The diaphragm 4 and the spring backing member 5 define a chamber 6 in which a fluid closing spring 7 is enclosed leak-free.

Figure 5:
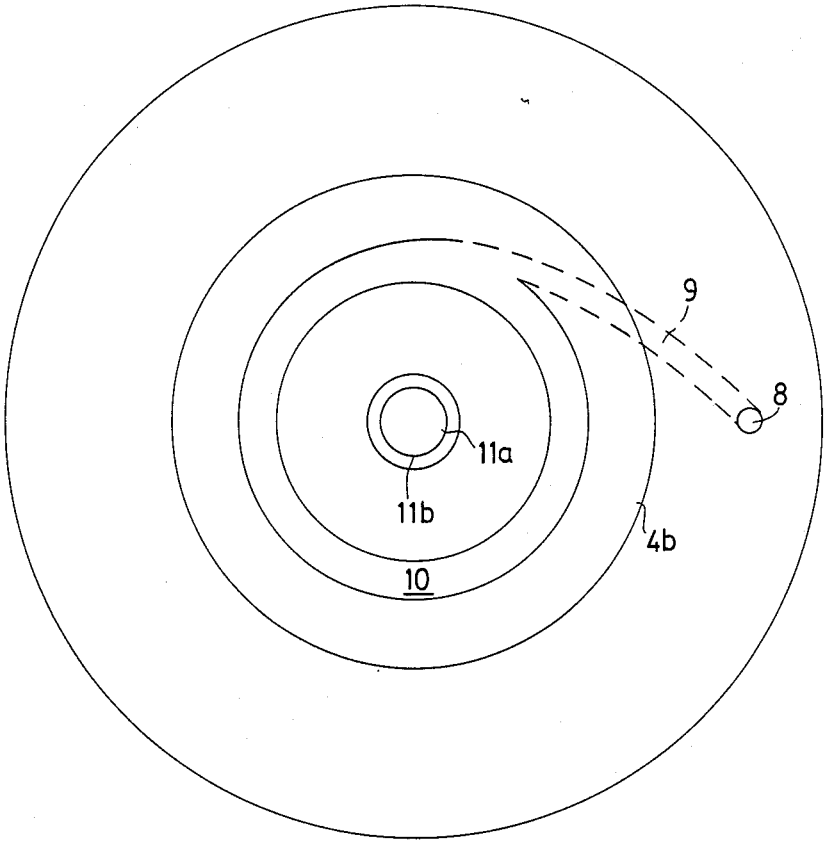
FIG. 5 shows a plan view of the injection nozzle of FIG. 1 with diaphragm valve and fluid spring removed at any point where the spring is normally located.

The fuel feed in the nozzle body 2 comprises a feed channel 8 from which a helical channel 9 branches and leads tangentially into a pressure chamber 10 as can be seen in FIG. 5. The pressure chamber 10 is formed by an annular groove in the valve seat surface 2*a*, and is covered by the diaphragm 4 when the diaphragm 4 is in the closed position. In the opened position, the injected fuel passes from the pressure chamber 10 via a spray hole 11 in the nozzle body 2 into the combustion chamber of the internal combustion engine.

Figure 2:
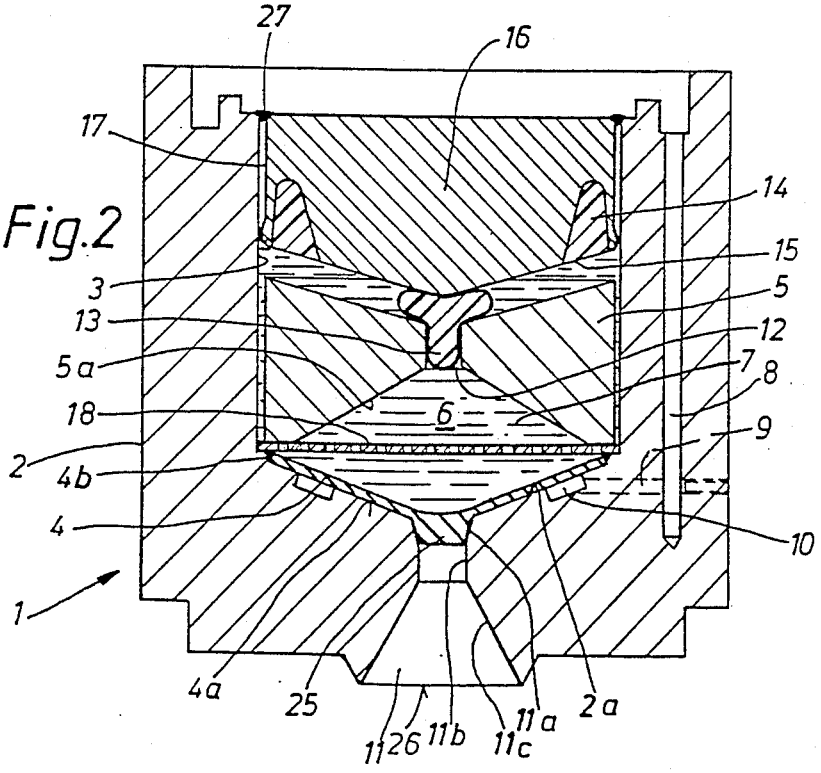
FIG. 2 shows the injection nozzle of FIG. 1 with the addition of a rigid perforated disc.
Figure 3:
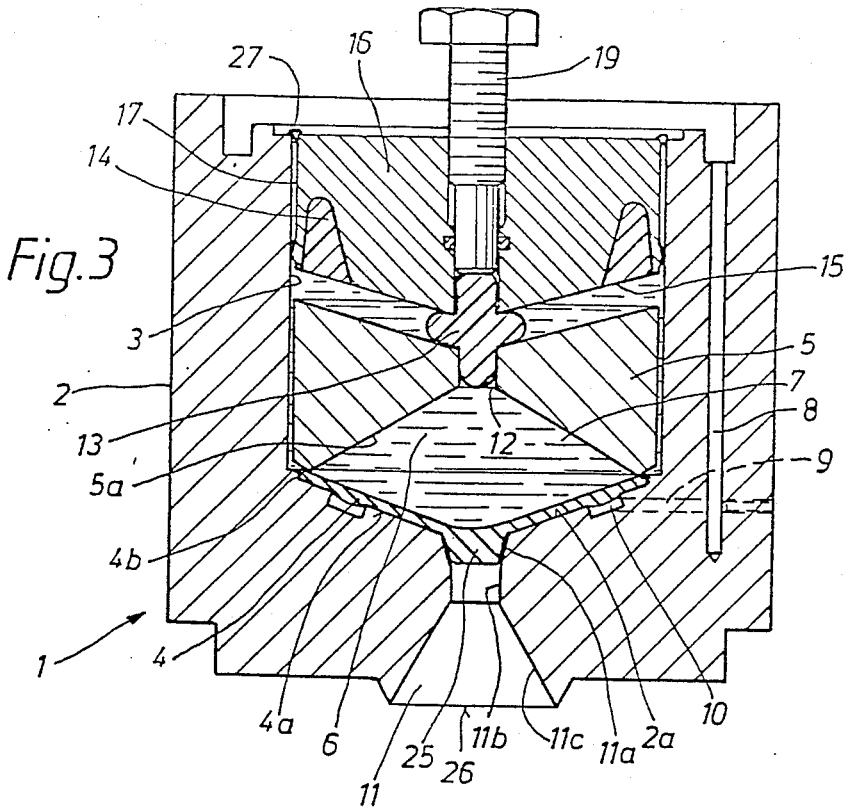
FIG. 3 shows an injection nozzle constructed in accordance with another preferred embodiment of the present invention.

In FIGS. 1, 2 and 3, the fluid closing spring sealed in the chamber 6 is formed by a special fluid, in certain preferred embodiments by a dilatant liquid having a viscosity which increases abruptly over the rate of flow, and will be discussed in more detail later.

The spring backing member 5, in FIGS. 1, 2 and 3 simply made as a spring-rated body, is provided on the diaphragm side with a conical supporting side 5*a*. Thus, the greatest distance between the spring backing member 5 and the diaphragm 4 is in the longitudinal axis of the injection nozzle 1. The spring 7 formed by the fluid therefore has a more flexible action on the inside (in the area of the longitudinal axis) than on the outside. In other words, when opening pressure is applied by the injected fuel, the diaphragm 4 has less support in the center than at the diaphragm edge, and therefore lifts to a greater extent in the spray-hole area than in the diaphragm edge area. This has an advantageous effect on the durability of the diaphragm.

So that a certain spring rigidity can be maintained, the chamber 6 filled with dilatant liquid must be air-free. The spring backing member 5 therefore has a central hole 12 which, after the dilatant liquid has been introduced and after assembly of the spring backing member 5, is first covered by a plastic part 13 which is at first cube or bowl shaped. A plastic or adhesive gel mass 14 is then introduced into an edged annular groove 15 of a lid 16.

The edged annular groove 15 is located in a conical surface which faces towards a correspondingly conical surface 5*b* of the spring backed member 5. The lid 16 is now pressed at constant speed into the cylindrical recess 3. At the same time, the plastic part 13 is deformed or pressed into the hole 12 and the spring backing member 5 is pressed onto the stop (diaphragm edge 4*b*).

Because of the design of the spring backing member 5, the plastic part 13 and the lid 16, all the air escapes upwards through a gap 17 between the lid 16 and the nozzle body 2. The system is air-free as soon as a sudden increase in force is measured. The increase in force is a result of the viscosity having suddenly increased on account of the high flow rate in the narrow gap 17. Further pressure is now slowly applied until the desired internal pressure of the system is reached. This internal pressure approximately corresponds to the nozzle opening pressure. After a Powerful blow on the lid 16, all of the fluid enclosed suddenly increases in viscosity—it momentarily becomes solid. The plastic mass 14 in the edged annular groove 15 arranged near to the lid edge transmits the extreme, sudden pressure increase in the fluid radially outwards. The edged annular groove 15 is thereby deformed and the lid 16 is fixed in sealing manner at this location to the nozzle body 2. By electron-beam or laser welding, the system is then hermetically sealed by a seam 27 at the upper end of gap 17.

In FIG. 2, the above-described injection nozzle 1 is additionally provided with a rigid perforated disc 18 which is clamped between the diaphragm 4 and the spring backing member 5. When the diaphragm 4 deflects as a result of the opening pressure, the perforated disc 18 produces a pronounced movement in the dilatant fluid, and thus causes a sudden increase in viscosity in the fluid chamber 6 to occur earlier so that the transformation from liquid to solid is quicker than in the embodiment of FIG. 1.

FIG. 3 shows another preferred embodiment with adjustable diaphragm pressure. Provided in the lid 16 is an adjusting screw 19 which, on adjustment, presses plastic part 13 further into the hole 12 so that the static diaphragm-supporting pressure in the chamber 6 increases.

Figure 4:
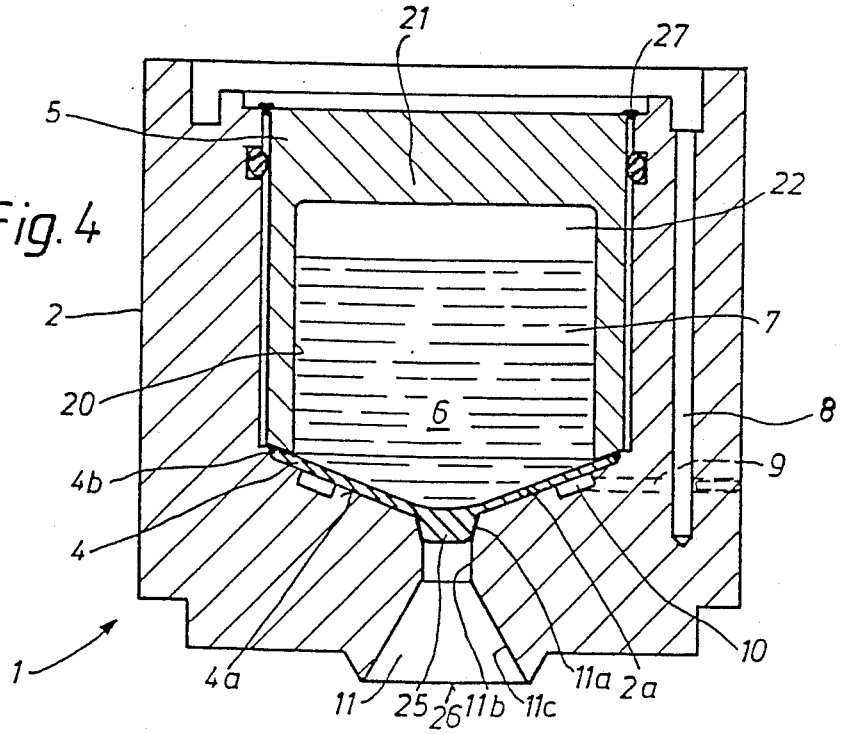
FIG. 4 shows an injection nozzle constructed in accordance with a further preferred embodiment of the present invention.

In the preferred embodiment of FIG. 4, the spring backing member 5 is cup-shaped. Here, a hollow body 20, together with the diaphragm 4, defines the chamber 6 in which a non-dilatant liquid 7 is enclosed, for example fuel, or a gel, for example grease. A gas or air cushion 22 is located between the liquid and the cup base 21, so that a more flexible spring rate is achieved. The supporting effect of the so-called gas-fluid spring on the diaphragm 4 is the same on the center and the outer edges of the diaphragm 4. Thus, the diaphragm 4 is made more rigid than the diaphragms supported by dilatant fluid.

All diaphragms 4 are provided with a spray plug 25 which projects into the spray hole 11, and is conical. This conical shape is adapted to the upper hole area 11*a* of the spray hole 11. Adjoining the upper hole area 11*a* is a short cylindrical hole area 11*b* which merges into a widening lower hole area 11*c* extending as far as the orifice 26 on the combustion chamber side.

The mode of operation of the injection nozzle is as follows: Fuel is conveyed from an injection pump (not shown) through the feed channel 8 and the helical channel 9 to the pressure chamber 10. The static pressure in the fluid above the diaphragm 4 at first keeps the pressure chamber 10 closed. Above a certain pressure, the non-rigid diaphragm 4 lifts and the fuel, due to its inertia, flows in a spiral toward the spray hole 11. An annular spraying cross-section develops at the spray plug 25. The fuel enters the combustion chamber, and because of its spiral direction of flow, expands into a jet in the shape of a cone or a conical envelope.

Since these operations occur very quickly, the fluid, for example, between the diaphragm 4 and the spring backing member 5 acts like a solid which obeys Hook's Law. Because of the variation in the distance between the diaphragm 4 and the body 5, the diaphragm 4 has less support towards the center than toward the outer edges, and therefore lifts to a greater extent in the center than away from the center.

As speed increases, the diaphragm lift and thus the cross-section of passage between the valve seat surface 2*a* and the diaphragm 4 increase.

By selection of the correct contour for the spring backing member 5, the tangential components of the rate of flow from the helical channel 9 to the spray hole 11 and therefore the angle of the conical jet are kept constant.

In certain preferred embodiments, diesel fuel or hydraulic oil are used as the fluid, and nitrogen is used as the gas. The opening pressure (the force of the closing spring) is about 500 bar. The spraying pressure is only slightly higher, but at a full load is about 100 bar above the opening pressure.

For a dilatant fluid that must withstand temperatures of 150° to 200°, a corresponding opening pressure is obtained. In this case, the drastic viscosity jump characteristic of a dilatant fluid that occurs when critical values of the shearing action and the shearing speed are exceeded, is utilized in order to achieve a correlated stiffness jump. In other words, the diaphragm carries out a lift that corresponds to that of a condensed fluid.

In certain preferred embodiments, the chamber 6 for the enclosed fluid has a volume of approximately 5 $cm^3$ for fluids, and 00.25 $cm^3$ for gas.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. An injection nozzle for injecting a variable amount of fuel into a combustion chamber of an air-compressing fuel-injection internal combustion engine, said nozzle having a diaphragm acting as a variable opening and closing valve means in a nozzle body to vary the amount of fuel injected into the combustion chamber, said diaphragm being liftable from a valve seat against a closing spring force as a function of injected-fuel pressure prevailing in a pressure chamber in said nozzle body to clear a spray hole leading towards said combustion chamber, wherein:

said diaphragm has a conical spray plug which is received in said spray hole when the diaphragm is in a closed position; and said nozzle includes enclosed fluid which is under pressure when said diaphragm is in said closed position for applying said closing spring force.

2. An injection nozzle according to claim 1, wherein said spray hole in its upper hole area has an inner circumference correspondingly shaped with a shape of an outer circumference of said spray plug.

3. An injection nozzle acording to claim 2, wherein said nozzle further includes: a cylindrical recess in said nozzle body; and a spring backing member firmly arranged in said cylindrical recess, said spring backing member resting on an edge of said diaphragm.

4. An injection nozzle according to claim 3, wherein said spring backing member has a conical supporting side which faces towards said diaphragm, said supporting side and said diaphragm defining a chamber which contains said fluid, said supporting side extending furthest from said diaphragm opposite said spray hole.

5. An injection nozzle according to claim 4, wherein said fluid is a dilatant liquid.

6. An injection nozzle according to claim 3, wherein said spring backing member is cup-shaped and has a hollow body which contains a non-dilatant liquid and a gas cushion, said liquid and cushion acting as a liquid-gas spring means on said diaphragm.

7. An injection nozzle according to claim 1, further including:

a feed channel;

a helical channel connected to said feed channel;

and an annular groove which forms said pressure chamber and into which said helical chamber opens tangentially;

wherein injected fuel is fed via said feed channel and said helical channel into said annular groove.

8. An injection nozzle according to claim 1, wherein said diaphragm has a generally overall conical shape with said plug being at an apex of the cone and with a circumferential edge of the cone secured to the nozzle body and wherein the apex of the cone is lifted a greater distance vertically away from the spray hole than the circumferential edge is lifted to provide for the variable opening and closing.

9. An injection nozzle according to claim 2, wherein said diaphragm has a generally overall conical shape with said plug being at an apex of the cone and with a circumferential edge of the cone secured to the nozzle body and wherein the apex of the cone is lifted a greater distance vertically away from the spray hole than the circumferential edge is lifted to provide for the variable opening and closing.

10. An injection nozzle according to claim 3, wherein said diaphragm has a generally overall conical shape with said plug being at an apex of the cone and with a circumferential edge of the cone secured to the nozzle body and wherein the apex of the cone is lifted a greater distance vertically away from the spray hole than the circumferential edge is lifted to provide for the variable opening and closing.

11. An injection nozzle according to claim 4, wherein said diaphragm has a generally overall conical shape with said plug being at an apex of the cone and with a circumferential edge of the cone secured to the nozzle body and wherein the apex of the cone is lifted a greater distance vertically away from the spray hole than the circumferential edge is lifted to provide for the variable opening and closing.

12. An injection nozzle according to claim 5, wherein said diaphragm has a generally overall conical shape with said plug being at an apex of the cone and with a circumferential edge of the cone secured to the nozzle body and wherein the apex of the cone is lifted a greater distance vertically away from the spray hole than the circumferential edge is lifted to provide for the variable opening and closing.

13. An injection nozzle according to claim 6, wherein said diaphragm has a generally overall conical shape with said plug being at an apex of the cone and with a circumferential edge of the cone secured to the nozzle body and wherein the apex of the cone is lifted a greater distance vertically away from the spray hole than the circumferential edge is lifted to provide for the variable opening and closing.

14. An injection nozzle according to claim 7, wherein said diaphragm has a generally overall conical shape with said plug being at an apex of the cone and with a circumferential edge of the cone secured to the nozzle body and wherein the apex of the cone is lifted a greater distance vertically away from the spray hole than the circumferential edge is lifted to provide for the variable opening and closing.

* * * * *